US010168034B2

(12) United States Patent
Hildebrand

(10) Patent No.: US 10,168,034 B2
(45) Date of Patent: Jan. 1, 2019

(54) DOWNLIGHT

(71) Applicant: ZUMTOBEL LIGHTING GMBH, Lemgo (DE)

(72) Inventor: Benjamin Hildebrand, Lage (DE)

(73) Assignee: ZUMTOBEL LIGHTING GMBH, Lemgo (DE)

( * ) Notice: Subject to any disclaimer, the term of this patent is extended or adjusted under 35 U.S.C. 154(b) by 0 days.

(21) Appl. No.: 15/502,873

(22) PCT Filed: Oct. 21, 2015

(86) PCT No.: PCT/EP2015/074336

§ 371 (c)(1),
(2) Date: Feb. 9, 2017

(87) PCT Pub. No.: WO2016/062754

PCT Pub. Date: Apr. 28, 2016

(65) Prior Publication Data

US 2017/0227196 A1 Aug. 10, 2017

(30) Foreign Application Priority Data

Oct. 21, 2015 (DE) ..... 20 2014 105 019 U

(51) Int. Cl.

| | |
|---|---|
| ***F21S 8/02*** | (2006.01) |
| ***F21V 17/16*** | (2006.01) |
| ***F21V 21/04*** | (2006.01) |

(52) U.S. Cl.

CPC ..... *F21V 21/047* (2013.01); *F21S 8/026* (2013.01); *F21V 17/164* (2013.01); *F21V 21/045* (2013.01)

(58) Field of Classification Search
None
See application file for complete search history.

(56) References Cited

U.S. PATENT DOCUMENTS

| | | | |
|---|---|---|---|
| 5,390,090 | A | 2/1995 | Nau |
| 6,364,511 | B1 | 4/2002 | Cohen |

FOREIGN PATENT DOCUMENTS

| | | |
|---|---|---|
| DE | 10145499 | 4/2003 |
| DE | 202008003338 | 5/2008 |
| DE | 102008005779 | 8/2009 |
| DE | 20202013102148 | 3/2014 |
| FR | 2646699 | 11/1990 |

OTHER PUBLICATIONS

German search report in foreign priority German application 20 2014 105 019.1 dated May 20, 2015.
International Search Report in parent PCT application PCT/EP2015/074336 dated Dec. 21, 2015.

*Primary Examiner* — Britt D Hanley
(74) *Attorney, Agent, or Firm* — Andrus Intellectual Property Law

(57) ABSTRACT

Disclosed is a downlight (100) comprising a mounting frame (50) to be mounted in the area of a ceiling mounting hole, and a light fixture (10) that is to be fastened to the mounting frame (50) and includes a luminaire head (30). The light fixture (10) is formed by a substantially C-shaped element having a main surface (11) and two angled wings (20) on two opposite sides of the main surface (11); the wings (20) of the light fixture (10) are designed in a flexible manner and in such a way as to interlock with the mounting frame (50).

13 Claims, 4 Drawing Sheets

DOWNLIGHT

CROSS REFERENCE TO RELATED APPLICATION

The present application is the U.S. national stage application of International Application PCT/EP2015/074336, filed Oct. 21, 2015, which international application was published on Apr. 28, 2016 as International Publication WO 2016/062754 A1. The International Application claims priority of German Patent Application 20 2014 105 019.1, filed Oct. 21, 2014.

FIELD OF THE INVENTION

The present invention relates to a downlight having a mounting frame to be mounted in the region of a ceiling mounting hole, and a light fixture to be attached to the mounting frame, having a luminaire head located thereon. In particular, the invention relates to a downlight with which the light fixture can be attached in a simple manner, without tools, to the mounting frame

BACKGROUND OF THE INVENTION

Lamps that are provided for attachment to a ceiling of a room that is to be illuminated and which are designed to project light substantially downward are normally referred to as "downlights." These are normally recessed lamps, which are designed such that they can be mounted in the mounting hole of a suspended ceiling element, e.g. a sheetrock ceiling.

Recessed ceiling lamps of this this type, in the form of downlights, are known in different configurations. Thus, lamps are known that have a circular light emission surface, and are then normally secured to the ceiling via a circular installation or mounting frame. In contrast, the present invention relates to downlights having an angular design, in particular square or rectangular. In this case, the mounting frame can be designed as a mount for a single light fixture as well as for numerous light fixtures that are to be disposed adjacently to one another.

The use of the mounting frame specified above serves to simplify the installation of the downlight, as well as later repair or maintenance measures. Only the mounting frame is permanently joined to the ceiling construction, e.g. via a screw connection or a special clamping construction, and optionally plastered over for optical reasons. The actual lamp, on the other hand, including the light fixture having the luminaire head located thereon, is designed such that it can be attached to the mounting frame in a releasable manner. The actual installation of the downlight can thus first occur when all of the other preparations, in particular the attachment and plastering of the mounting frame have been completed. Furthermore, it is not necessary to fully remove all of the components in order to exchange the luminaire head, or the light source of the downlight, but rather, it is sufficient to release only the light fixture from the mounting frame, wherein the mounting frame remains permanently in the ceiling. For this it is necessary, as a matter of course, to enable a simple, reversible attachment of the light fixture to the mounting frame, while at the same time the connection is designed such that the light fixture having the luminaire head located thereon is reliably retained on the mounting frame and cannot release itself therefrom.

Different solutions for this are known from the prior art. A first known variation provides, for example, that the light fixture is placed in the mounting frame such that it is slightly twisted, and is then locked in place therein. A locking in place via a special spring mechanism or a screwing of the light fixture to the mounting frame is also known. None of these various variations, however, have proven to be optimal, because, e.g., with the first variation, in which a twisted insertion and subsequent locking in place is provided, the light fixture together with the recessed lamp cannot exceed the width of the frame with regard to its height. Furthermore, for this type of installation, an extremely stable light fixture is required, and an additional securing, e.g. in the form of a snapping or locking in place, is required, in order to eliminate the risk of the light fixture falling out of the mounting frame when it is moved. A removal of the light fixture in this case necessarily requires a lot of effort and strength, wherein the same also applies with the use of corresponding spring mechanisms, because in this case, the springs must be designed such that they are strong enough to retain the light fixture with the additional luminaire head. Furthermore, in this case a relatively large gap is necessary in order to enable removal, potentially using tools. This leads in turn to the possibility that unattractive gaps may result with so-called channel solutions, in which numerous light fixtures are disposed adjacently to one another in a mounting frame.

SUMMARY OF THE INVENTION

The present invention addresses the objective of creating a novel solution for implementing a downlight in which the disadvantages described above, known from the prior art, are avoided.

The solution according to the invention is based on a special design of the light fixture, which is to be releasably joined to the mounting frame. According to the invention, it is provided that the light fixture is formed by a downward facing, substantially C-shaped element having a main surface and two angled wings disposed on opposite sides of the main surface, wherein the wings of the light fixture are flexible and designed to snap into the mounting frame. The solution is distinguished in that the light fixture has a relatively simple design, but also enables a simple and reliable releasable attachment to the mounting frame. The snap-on connection formed thereby is stable, such that even heavier luminaire heads can be retained without difficulties. Furthermore, the solution according to the invention provides the possibility, in a simple manner, of disposing numerous similar light fixtures adjacent to one another on a common mounting frame.

Thus, a downlight is proposed according to the invention, having a mounting frame that is to be installed or attached in a region of a ceiling mounting hole, and a light fixture that is to be attached to the mounting frame, having a luminaire head located thereon, wherein the light fixture is formed by a downward facing, substantially C-shaped element having a main surface and two angled wings disposed on opposite sides of the main surface, and wherein the wings of the light fixture are flexible, and designed to snap into the mounting frame.

The wings of the light fixture preferably each have snap-in means, directed outward on their ends lying opposite the main surface, for snapping into the mounting frame. These snap-in means can each be a locking lug, in particular, wherein the mounting frame then has locking recesses that are complementary to the locking lugs. In order to facilitate a potential releasing of the snap-in connection, and thus a removal of the light fixture, the locking lugs can each be provided with a hole or a recess, which enables a release of the snap-in connection by means of a tool. As shall be explained in greater detail later, however, these holes are not absolutely necessary, because due to the special design of the light fixture, it can, if necessary, also be removed from the mounting frame without any tools.

A particularly advantageous further development of the present invention provides that in order to facilitate the installation, guide elements are formed on the outer surfaces of the wings of the light fixture. These are designed, such that when the light fixture is inserted into the mounting frame, a deflection of the associated wings occurs so that the snap-in means slide along the inner edge of the mounting frame in order to subsequently be able to snap together with the mounting frame. These guide elements, which are preferably each formed by two ribs and extend on both sides of the snap-in means, prevent the snap-in means from grinding along the inner edge of the frame, thus damaging it thereby. On the other hand, there is the possibility of designing the snap-in means, such that they are designed particularly well for absorbing a corresponding force, because they themselves are not responsible for deflecting the associated wings of the light fixture when it is placed in the mounting frame.

The light fixture of the downlight according to the invention is preferably made of plastic. The luminaire head disposed thereon can be adjustable, in particular it can be rotatably disposed on the light fixture. In particular, this can be a so-called Cardan suspension.

The mounting frame designed in accordance with the invention can be used to accommodate a single light fixture. Or, as specified above, the solution according to the invention also provides the possibility of disposing numerous light fixtures having a similar design on a common mounting frame in a simple manner.

BRIEF DESCRIPTION OF THE DRAWINGS

The invention shall be explained in greater detail below based on the attached drawings. Therein.

DETAILED DESCRIPTION

Figure 1:
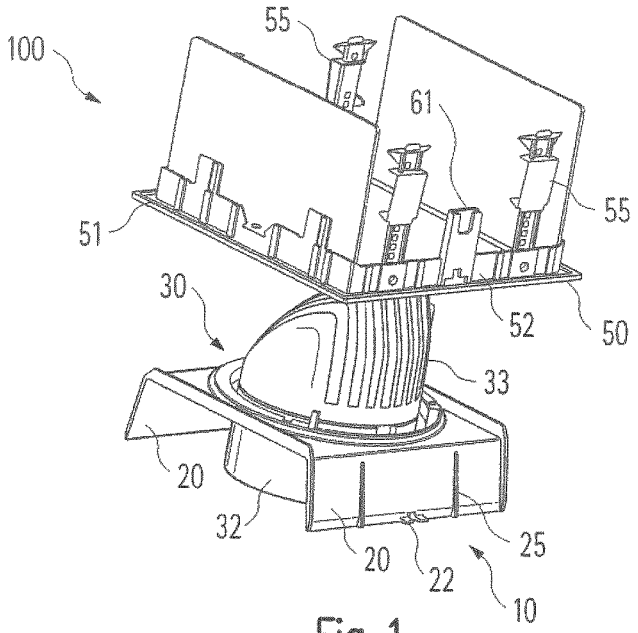
FIG. 1 shows a perspective view of the main components of an exemplary embodiment of a downlight according to the invention.
Figure 2:
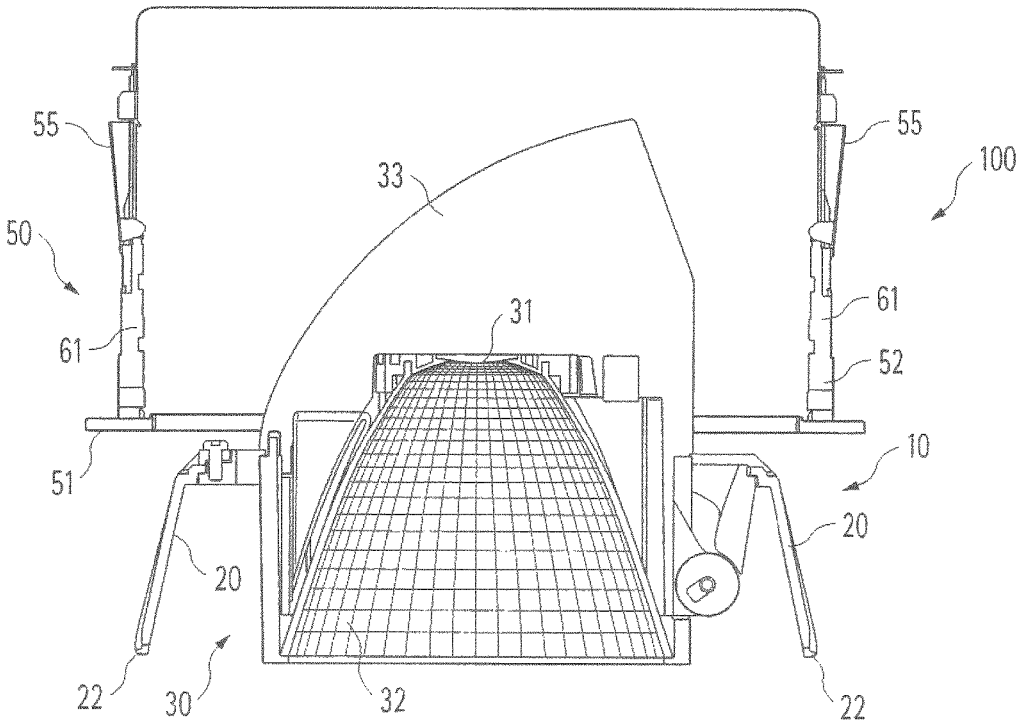
FIG. 2 shows a sectional view of the downlight from FIG. 1.

FIGS. 1 and 2 first show, in two different perspectives, the main components of a downlight designed according to the invention, provided as a whole with the reference symbol 100. As described in the introduction, this downlight 100 is designed to be installed in a mounting hole—square in this case, and not shown—of a suspended ceiling. Light is then projected downward onto a region that is to be illuminated. Downlights of this type have many uses, both for lighting work spaces as well as in spaces of public buildings, e.g. museums and the like.

The attachment of such downlights to a ceiling construction is normally such that initially a first element is joined permanently and securely to the ceiling such that all of the other components can be releasably installed on this first attached element. A so-called installation frame or mounting frame 50 is the element permanently joined to the ceiling, which is adapted to the mounting hole in the ceiling with regard to its shape and size. In the present case, it is assumed that the mounting hole in the ceiling is square, for which reason the mounting frame 50 depicted here also has a square fundamental shape.

As is also already known from the prior art, the mounting frame has an angled configuration, having an encompassing flange 51 directed outward, which bears on the undersurface of the ceiling when he frame 50 is installed, as well as an encompassing ridge 52 that extends into, or through, the hole in the ceiling. The encompassing flange 51 serves to compensate for, or cover any irregularities in the ceiling mounting hole. On its inner surface it abuts on the actual mounting hole, in which the light fixture, which shall be explained in greater detail below, is then inserted. This flange 51 is frequently plastered over—at least in part—after it has been attached to the ceiling to achieve a particularly inconspicuous transition between the ceiling and the elements of the lamp.

The mounting frame 50 can be designed as either a single piece, as is particularly favorable with frames of a smaller size or as numerous separate profile parts, which are assembled to form the frame when installed in the ceiling. This modular construction of the frame 50 can be used in particular when the system is to be flexible, in order to dispose a desired number of downlights adjacent to one another. The mounting frame 50 also does not necessarily have to include the outward facing flange region that bears on the undersurface of the ceiling, but rather, it can be designed in the manner of a version that is flush with the ceiling, such that it only has a ridge extending slightly inward, which then in turn abuts the mounting hole.

The attachment of such a mounting frame 50 to the ceiling can occur by a number of means, e.g., screw connections are known, and would also be suitable in the present case. In the depicted exemplary embodiment, however, special locking elements 55 are provided, which are disposed on opposing sides of the mounting frame 50. These locking elements 55 are formed, in particular, by height adjustable and outward pivotable tabs, which are first oriented vertically downward in the configuration depicted in FIG. 1, such that they pass through the ceiling mounting hole when the mounting frame 50 is placed in the ceiling. These locking elements 55 are subsequently pivoted outward and pressed down by means of a special actuating mechanism or by hand, such that they come to bear against the upper surface of the suspended ceiling. The ceiling is then clamped between the locking elements 55 on one side and the outward protruding flange region 51 of the mounting frame 50 on the other side, such that the mounting frame 50 is securely joined to the ceiling. Locking elements of this type are already known from earlier downlights or other recessed ceiling lights, for which reason there shall be no further description thereof. As stated above, the attachment of the frame to the ceiling can also be achieved by other means as a matter of course.

After the mounting frame 50 has been installed, the installation of the components of the downlight responsible for emitting light occurs in a second step. These components are located in a so-called luminaire head, provided in the present case with the reference symbol 30. The luminaire head 30 contains a light source 31, e.g. in the form of an LED, the light from which is projected downward using a downward directed, pot-like reflector 32. The heat resulting during operation of the light source 31 is discharged into the ambient air through a cooling element 33, which extends upward—as shown in the illustration—and is disposed inside the intermediate region between the suspended ceiling and the structural ceiling above when in the installed state. Depending on the type of desired light emission, different light sources and/or different optical elements may be provided, in order to influence the light emission. The power supply for the light source 31 can be obtained by means of a separate control and power supply unit or an appropriate integrated unit.

The luminaire head 30 itself can have different designs. For a releasable attachment to the mounting frame 50, it is retained by a light fixture 10, which is designed according to the invention in the manner described in greater detail below. In the present case, it is provided the luminaire head 30 is disposed on the light fixture 10 such that it can be rotated, and also pivoted in relation thereto, in order to form a so-called Cardan lamp, which enables a nearly arbitrary orientation of the light projection. A rigid connection between the luminaire head 30 and the light fixture 10 is also possible, however, the light fixture 10 can also be an integral component of the luminaire head 30.

The invention is not limited to the depicted embodiment of the luminaire head 30. Instead, the luminaire head 30 can be designed in a number of ways, and joined in each case in a corresponding manner to the light fixture 10. In particular, an embodiment having a rectangular or square light projection region is possible, wherein the hole in the main surface then has a square shape, and e.g., the reflector of the—non-rotatable in this case—luminaire head is shaped accordingly. The size of the hole in the main surface of the light fixture, and thus the size of the light projection region of the luminaire head, can also be varied. One advantage of the solution according to the invention is that the light fixture can be combined with luminaire heads of different designs, which only requires an appropriate adjustment of the main surface of the light fixture.

The present invention also relates in particular to the manner in which the light fixture 10 can be releasably attached to the mounting frame 50. As specified above, different solutions for this are known from the prior art, each of which has, however, certain disadvantages. In contrast, the solution according to the invention provides the possibility of attaching the light fixture 10 to the mounting frame 50 in a simple and quick manner, and—if necessary—also removing it therefrom, wherein both steps can be carried out without tools.

Figure 5:
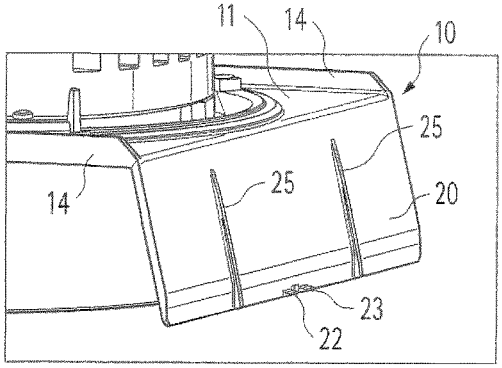
FIG. 5 shows the side view of the light fixture.
Figure 4:
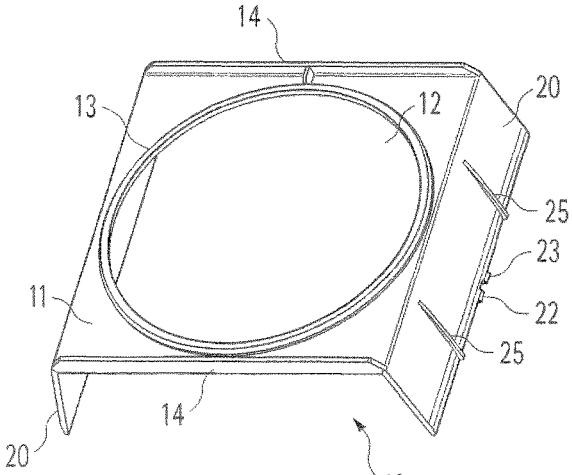
FIG. 4 shows a light fixture designed according to the invention, in a perspective view.
Figure 6:
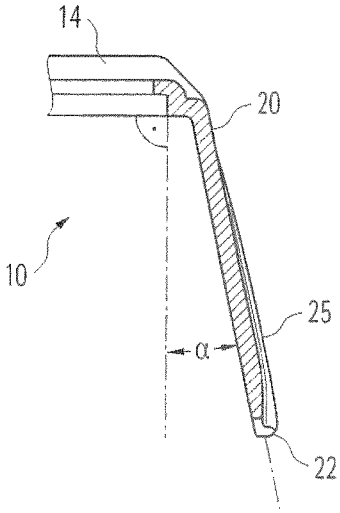
FIG. 6 shows a sectional view of the wing of the light fixture.

The light fixture 10 according to the invention is distinguished thereby, firstly by its fundamental shape, in the manner of a C, corresponding to the sectional view in FIG. 2 as well as the views in FIGS. 4 to 6. I.e. the light fixture 10 first has a main surface, provided with the reference symbol 11, which serves to accommodate the luminaire head 30. Because an adjustability of the luminaire head 30 is to be enabled in the present case, as specified above, it is provided that this main surface 11 has a circular hole 12 having an encompassing edge region 13, which serves to create a rotatable support for the luminaire head 30. There are two short tabs, or ridges 14, directed upward, on both sides of this hole 12, which increase the stability of the light fixture 10 in the region of the main surface 11. The light fixture 10 is preferably made of plastic, but it could certainly be made of another material, e.g. sheet metal.

Two wings 20 disposed on both sides of the main surface 11 are responsible for the actual attachment of the light fixture 10 to the mounting frame 50, which are directed downward and assume an angle $\alpha$ of approx. 10° to 20°, preferably approx. 15° in an outward direction in relation to the vertical (it is assumed thereby that the main surface is horizontal) (see FIG. 6). These wings 20 exhibit a certain flexibility in relation to the main surface 11, such that they can be pushed inward in order to enable—as described below—an insertion into and removal from the mounting frame 15.

Figure 3:
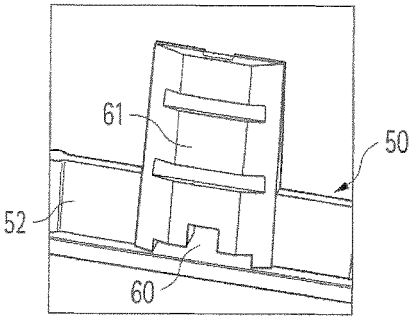
FIG. 3 shows an enlarged view of the mounting frame, having the locking recess located therein.

An attachment of the light fixture 10 to the mounting frame 50 is achieved thereby using snap-in means, which are implemented by means of two locking lugs 22, which are formed on the lower ends of the wings 20. These locking lugs 22 are designed such that they interact with corresponding locking recesses 60 of the mounting frame 50, wherein these locking recesses 60 are formed on the inner surfaces of two upward directed ridges 61 of the mounting frame 50. These ridges 61 having the locking recesses 60 can be seen in detail in the illustration in FIG. 3.

As is furthermore visible in FIGS. 4 and 5, the locking lugs 22 can each have a cut-out or a slot or a hole 23 in approx. the middle, which extends into the lower region of the wing 20, and enables the insertion of a tool, e.g. a small standard screwdriver, when the light fixture 10 is in the installed state. The screw driver can be inserted from below through the hole 23, until it bears on the ridges 61 of the mounting frame 50. By subsequently pivoting the screwdriver, or some other tool, the locking lugs 20 can then be lifted, or pushed, out of the corresponding holes 60, and the connection between the mounting frame 50 and the light fixture 10 is thus released.

Because the locking lugs 22 should protrude from the lateral surfaces of the wings 20 at as close to a right angle as possible, in order to ensure a reliable snap-in connection between the mounting frame 50 and the light fixture 10, the locking lugs 22 themselves are not capable of deflecting of the wings 20 when the light fixture 10 is placed in the mounting frame 50. Instead, the locking lugs 22 remain lodged against the inner edge of the flange region 51 of the mounting frame. Accordingly, guide elements in the form of ribs 25 are provided on the wings 20 on both sides of the locking lugsin each case, in accordance with a particularly preferred embodiment corresponding to the illustrations. The ribs 25 extend downward to the lower edge of the respective wing 20 and are designed to slide along the inner edge of the flange region 51 of the mounting frame 50 when the light fixture 10 has been inserted, in order to deflect or bend the associated wing 20 inward. I.e., these so-called "shoe-horn" ribs 25 provide the necessary inward deflection of the wing 20, such that the locking lugs 22 slide along the lower edge of the mounting frame 50 and can subsequently engage in the associated locking recesses 60. As a result, the installation is facilitated, and in addition, damage, e.g. scratches or suchlike, to the mounting frame 50 by the locking lugs 20 is prevented.

Figure 7:
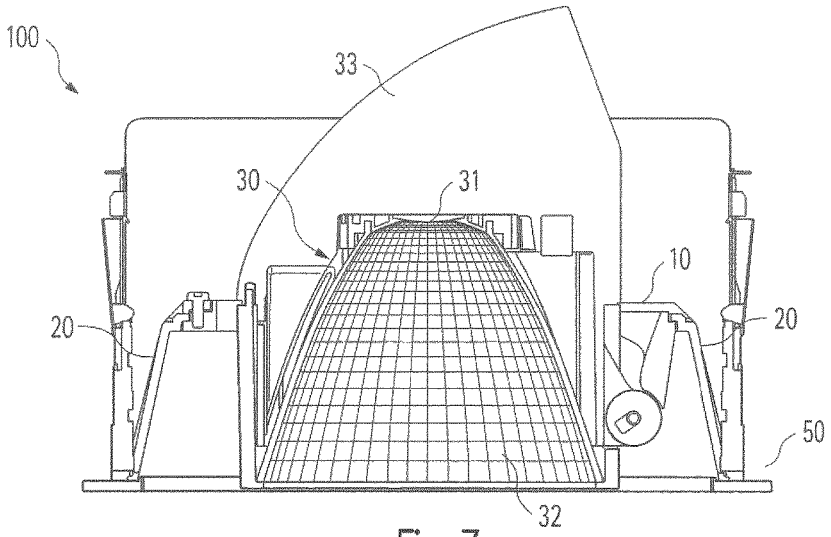
FIG. 7 shows a sectional view of the light fixture inserted into the mounting frame.
Figure 8:
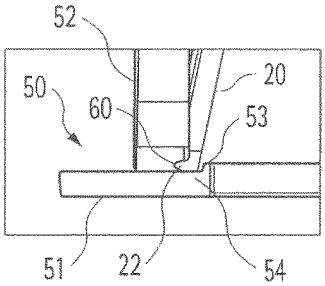
FIG. 8 shows an enlarged view of the region of the snap-in connection between the mounting frame and the light fixture.

The light fixture 10 having the luminaire head 30 located thereon is shown in the installed state in FIGS. 7 and 8, wherein the manner in which the locking lugs 22 engage in the associated locking recesses 60 of the mounting frame 50 can be seen in particular in FIG. 8. In fact, a sufficiently reliable retention of the light fixture 10 can be achieved with only two locking lugs 22 located on opposite sides, such that further or additional securing measures are not necessary.

The securing of the light fixture 10 to the mounting frame 50 is improved thereby with a supporting lip or supporting rib 53, which can be seen in particular in the enlarged depiction in FIG. 8. This supporting rib 53 is formed on a region 54 of the flange region 51 of the mounting frame 50 that extends slightly downward, on which the light fixture (i.e. wing 20) bears, and forms a small ridge projecting upward. These ribs 53 prevent an inward deflection of the flexible wings 20 of the light fixture 10, such that secure retention on the mounting frame 50 is further ensured. This retention is increased by the weight of the light fixture 10 and the associated luminaire head 30, because they push the lower edges of the wings 20 into the bearing region, or receiving region, between the locking recess 60 and the supporting rib 53, and thus prevent the snap-in connection from releasing on its own.

The solution according to the invention is also distinguished in that, as a result of the special manner of the interaction between the mounting frame 50 and the light fixture 10, the installation and removal is simplified. This can be seen based on the FIGS. 9 and 10 described below, which show the insertion of the light fixture 10 into a mounting frame 50 on one hand, and the later removal thereof on the other hand. In the present case, it is assumed that numerous similar light fixtures 10 are to be disposed collectively in a mounting frame 50, wherein the figures each show the installation or removal of the respective first light fixture.

Figure 9A:
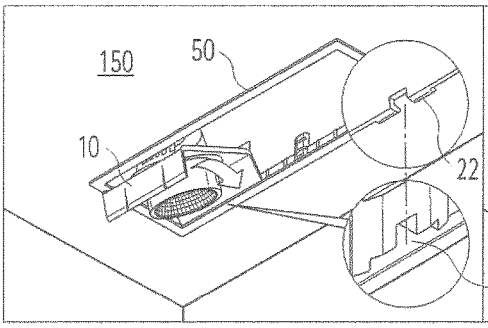
FIGS. 9*a* and 9*b* show the steps for installing the light fixture in a mounting frame.
Figure 9B:
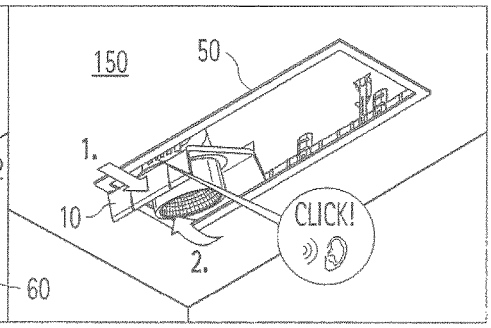

The preferred approach for installing the light fixture 10 comprises the light fixture 10 first being placed at a slight angle on the mounting frame 50 that has already been attached to the ceiling 150, such that the locking lug 22 of one of the two wings 20 already engages in the corresponding locking recess 60 of the mounting frame 50—as illustrated in FIG. 9*a*. The opposite region of the light fixture 10 is subsequently pushed, or pivoted, upward, wherein the inward deflection of the wings 20 is facilitated, or supported, by the ribs 25 described above. As soon as the relevant locking lug 22 has passed over the inner edge of the mounting frame 50 it can engage in the opposite locking recess 60, which is indicated by a clicking sound. In this manner, it is thus immediately evident to the installer that the light fixture 10 has been attached to the mounting frame 50 in the correct manner.

Figure 10A:
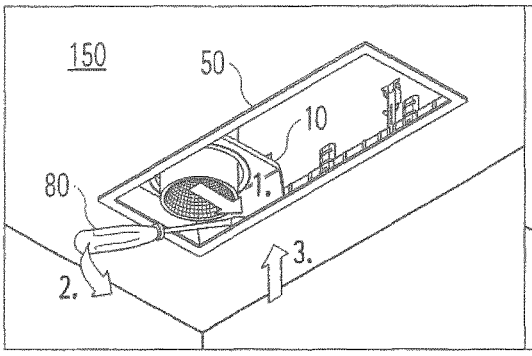
FIGS. 10*a* and 10*b* show the steps for releasing the light fixture from the mounting frame.
Figure 10B:
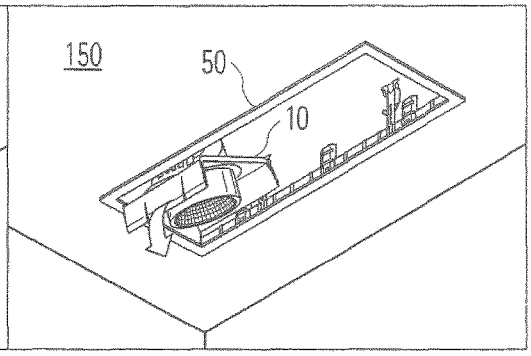

The releasing of the snap-in connection is depicted schematically in FIGS. 10*a* and 10*b*, wherein a tool 80 in the form of a screwdriver is used for this purpose. This tool is inserted through the hole 23 specified above, into the region between the locking recess 60 and the locking lug 22, and subsequently pivoted, such that the snap-in connection is released. The light fixture 10 can then be released from the snap-in connection on the opposite side by a subsequent pivoting, and removed. Alternatively thereto, it is also possible to displace the light fixture in a lateral direction in a first step, resulting in the snap-in connection between the light fixture 10 and the mounting frame 50 being released on one side. The light fixture 10 can then also be ultimately removed in this case as well through a subsequent pivoting.

Ultimately, a very simple installation and removal of the components of a downlight responsible for emitting light is obtained using the solution according to the invention. At the same time, a connection between the light fixture and the mounting frame is obtained that is that is sufficiently secured to reliably support a heavier luminaire head without additional securing measures. Furthermore, the invention enables the possibility of attaching numerous similar light fixtures to one mounting frame.

What is claimed is:

1. A downlight (100) having a mounting frame (50) that is to be mounted in a region of a ceiling mounting hole, as well as a light fixture (10) that is to be attached to the mounting frame (50), having a luminaire head (30) located thereon, wherein the light fixture (10) has a main surface (11) with an opening through which the luminaire head is retained by the main surface and two wings (20) angling downward from the main surface and disposed on opposite sides of the main surface (11), and wherein the wings (20) of the light fixture (10) are flexible, and designed to be snapped into the mounting frame (50); and further wherein the wings (20) of the light fixture (10) each comprise snap-in means on their ends opposite the main surface (11) for snapping into the mounting frame (50) and the snap-in means comprise outwardly directed locking lugs (22), and the mounting frame (50) has locking recesses (60) that are complementary to the locking lugs (22) and the locking lugs (22) each have a hole (23) or cut-out, which enables releasing of the respective snap-in connection with a tool (80).

2. A downlight (100) having a mounting frame (50) that is to be mounted in a region of a ceiling mounting hole, as well as a light fixture (10) that is to be attached to the mounting frame (50), having a luminaire head (30) located thereon, wherein the light fixture (10) has a main surface (11) with an opening through which the luminaire head is retained by the main surface and two wings (20) angling downward from the main surface and disposed on opposite sides of the main surface (11), and wherein the wings (20) of the light fixture (10) are flexible, and designed to be snapped into the mounting frame (50); and wherein the downlight further comprises guide elements formed on the outward facing surfaces of the wings (20) of the light fixture (10), which cause a deflection of the associated wings (20) when the light fixture (10) is inserted into the mounting frame (50).

3. The downlight according to claim 2 further comprising outwardly directed locking lugs (22), wherein the mounting frame (50) has locking recesses (60) that are complementary to the locking lugs (22) and the guide elements are two ribs (25), which extend on both sides of the respective locking lugs.

4. A downlight (100) having a mounting frame (50) that is to be mounted in a region of a ceiling mounting hole, as well as a light fixture (10) that is to be attached to the mounting frame (50), having a luminaire head (30) located thereon, wherein the light fixture (10) has a main surface (11) with an opening through which the luminaire head is retained by the main surface and two wings (20) angling downward from the main surface and disposed on opposite sides of the main surface (11), and wherein the wings (20) of the light fixture (10) are flexible, and designed to be snapped into the mounting frame (50); and further wherein the mounting frame (50) has supporting ribs (53) on a bearing region for the light fixture (10), which prevent an inward deflection of the flexible wings (20).

5. The downlight according to claim 1 wherein the light fixture (10) is made of plastic.

6. The downlight according to claim 1 wherein the luminaire head (30) is disposed on the light fixture (10) such that it can be rotated.

7. The downlight according to claim 1 wherein the mounting frame (50) is designed as a mount for numerous light fixtures (10).

8. The downlight according to claim 2 wherein the light fixture (10) is made of plastic.

9. The downlight according to claim 2 wherein the luminaire head (30) is disposed on the light fixture (10) such that it can be rotated.

10. The downlight according to claim 2 wherein the mounting frame (50) is designed as a mount for numerous light fixtures (10).

11. The downlight according to claim 4 wherein the light fixture (10) is made of plastic.

12. The downlight according to claim 4 wherein the luminaire head (30) is disposed on the light fixture (10) such that it can be rotated.

13. The downlight according to claim 4 wherein the mounting frame (50) is designed as a mount for numerous light fixtures (10).

* * * * *